United States Patent [19]

Michaud

[11] Patent Number: 4,818,333

[45] Date of Patent: Apr. 4, 1989

[54] METAL SURFACE REFINEMENT USING DENSE ALUMINA-BASED MEDIA

[75] Inventor: Mark D. Michaud, Bristol, Conn.

[73] Assignee: Rem Chemicals, Inc., Southington, Conn.

[21] Appl. No.: 80,911

[22] Filed: Aug. 3, 1987

[51] Int. Cl.[4] ..... B24B 1/04; C23F 1/00

[52] U.S. Cl. ..... 156/628; 156/637; 156/638; 156/639; 156/645; 156/664; 51/313; 51/316

[58] Field of Search ..... 156/628, 637, 638, 639, 156/645, 644, 664; 51/313, 315, 316, 309; 148/6.14 R

[56] References Cited

U.S. PATENT DOCUMENTS

| | | | |
|---|---|---|---|
| 3,071,456 | 1/1963 | Cheesman | 51/316 |
| 3,751,861 | 8/1973 | Frost et al. | 51/316 |
| 3,848,373 | 11/1974 | Pletscher | 51/313 |
| 3,979,858 | 9/1976 | Semones et al. | 51/316 |
| 4,491,500 | 1/1985 | Michaud et al. | 156/628 |
| 4,685,937 | 8/1987 | Hori et al. | 51/309 |

FOREIGN PATENT DOCUMENTS

| | | | |
|---|---|---|---|
| 60-99554 | 6/1985 | Japan | 51/316 |
| 1175683 | 8/1985 | U.S.S.R. | 51/309 |
| 842224 | 7/1960 | United Kingdom | 51/316 |

OTHER PUBLICATIONS

"Tipton Barrel Finishing" brochure, Tipton Mfg. Corp.

Article "Vibratory Finishing with Chemical Accelerators" in the Jan. 72 issue of Plating Magazine (pp. 38–40).

*Primary Examiner*—David L. Lacey

*Assistant Examiner*—Andrew J. Anderson

*Attorney, Agent, or Firm*—Ira S. Dorman

[57] ABSTRACT

The invention provides a physicochemical process for refining relatively rough metal surfaces to a condition of high smoothness and brightness, in relatively brief periods of time, which is characterized by the use of a non-abrasive, high-density burnishing media. The process can be carried out in one step and with minimal production of media fines, thus affording economic and environmental advantages.

25 Claims, No Drawings

METAL SURFACE REFINEMENT USING DENSE ALUMINA-BASED MEDIA

BACKGROUND OF THE INVENTION

A physicochemical process for refining metal surfaces is described and claimed in Michaud et al U.S. Pat. No. 4,491,500, which process involves the development, physical removal and continuous repair of a relatively soft coating on the surface. High points are leveled through mechanical action, preferably developed in vibratory mass finishing apparatus, and very smooth and refined surfaces are ultimately produced in relatively brief periods of time.

The patentees teach that the process can be carried out using either a part-on-part technique or by incorporating an abrasive mass finishing media; e.g., quartz, granite, aluminum oxides, iron oxides, and silicon carbide, which may be held within a matrix of porcelain, plastic, or the like. As described therein, the effectiveness of the process is evidently attributable to the selective removal of surface irregularities, which removal has been facilitated by chemical conversion of the metal to a softer form.

Although the Michaud et al process is most effective and satisfactory, it is self-evident that the realization of even higher production rates and improved quality of the ultimate workpiece surface would constitute valuable advances in the art. This would of course be especially so, moreover, if those benefits were achieved by a process that is more economical, facile and environmentally attractive to carry out.

To achieve ultimate refinement of the metal surface, it will generally be desirable to finish the Michaud et al process with a burnishing step, which may be carried out by treatment of the parts in a mass finishing unit charged with a so-called burnishing media and an aqueous alkaline soap solution, the latter being inert to the metal. Such burnishing media will typically be composed of mineral oxide grains fused to a hard, dense, non-abrasive cohesive mass; it is also commonly known to use steel balls for burnishing metal parts.

It has in the past been standard practice to first treat the workpieces in a vibratory bowl containing abrasive media (e.g., grit-filled ceramic loaded to about 20 to 40 percent with the abrasive grains, when the operation is chemically promoted), and to then transfer them to a second bowl filled with a burnishing media; however, doing so is obviously inconvenient, time-consuming, and expensive. The process described by Michaud et al can be employed to produce burnished parts, without transferring them to a second bowl, by using a relatively nonaggressive cutting medium (e.g., a ceramic containing 10 to 15 percent of abrasive grit). In such a procedure, the initial, surface-refinement phase is carried out with a reactive solution which produces the conversion coating on the parts, followed by a flushing step and then a flow of a burnishing soap solution, with the equipment in operation.

Although highly advantageous, such a method may not produce ultimate refinement of the metal surfaces (e.g., specular brightness), since it is characteristic of abrasive media that they scratch the metal surfaces. Also, to be effective the grit particles of such media must continuously fracture, providing fresh, sharp edges to achieve the cutting function; it is obvious that, for environmental reasons, the solutions used in the process must therefore be treated to remove the particulates so produced, as well as to remove the powdery residue and grains released by attrition of the ceramic matrix.

Accordingly, it is the broad object of the present invention to provide a novel and highly effective process for the refinement of metal surfaces utilizing a physicochemical finishing technique.

It is a more specific object of the invention to provide such a process by which enhanced surface refinement may be achieved at a faster rate than has heretofore been realized by comparable means.

It is a further object of the invention to provide a process having the foregoing features and advantages, which is also more economical and facile to carry out than earlier processes of the same kind, and which offers environmental advantages.

It is another specific object to provide a novel physicochemical process by which relatively rough metal surfaces can be brought to a specular condition in one step; i.e., with one media and without transfer of the parts.

SUMMARY OF THE INVENTION

It has now been found that the foregoing and related objects of the invention are attained by the provision of a surface-refinement process in which a mass of elements, including a quantity of objects having relatively rough metal surfaces, and a solution capable of converting the surfaces to a softer form, are introduced into the container of a mass finishing unit and are rapidly agitated therein to produce relative movement among the elements and to maintain the surfaces in a wetted condition with the solution, for conversion of any exposed metal, on a continuous basis. A quantity of relatively nonabrasive solid media elements are included, the amount and size of which are such that, under the conditions of agitation, relative sliding movement is promoted among them and with respect to the objects. The media elements are comprised of a mixture of oxide grains, fused to a coherent mass and substantially free of discrete abrasive particles, the coherent mass containing, on an oxygen-free basis, about 60 to 80 weight percent aluminum and about 5 to 30 weight silicon. They will have a density of at least about 2.75 grams per cubic centimeter (g./cc) and preferably an average diamond pyramid hardness (DPH) value of at least about 845; taken in quantity, the media elements will have a bulk density of at least about 1.70 grams per cubic centimeter.

In one preferred embodiment, the coherent mass of which the media elements are composed will consist essentially of about 76 to 78 weight percent aluminum, about 10 to 12 weight percent silicon, about 5 to 9 weight percent iron and about 4 to 6 weight percent titanium, on an oxygen-free basis. Alternatively, the mass may consist essentially of about 63 to 67 weight percent aluminum, about 26 to 36 weight percent silicon, about 2 to 4 weight percent sodium, about 1 to 2 weight percent potassium, and about 0.5 to 0.8 weight percent phosphorous, expressed on the same basis. In another specific form, the composition may be about 62 to 73 weight percent aluminum, about 7 to 14 weight percent silicon, about 10 to 25 weight percent manganese, and about 1 to 4 weight percent sodium.

Most desirably, the oxide grains of which the coherent mass is comprised will have diameters that are not in excess of about 25 microns, and normally substantially all of them will have diameters of at least one micron. The density of the mass will usually be less than about 3.5 grams per cubic centimeter, its diamond pyramid hardness value will be less than about 1,200, and the bulk density of the elements will be less than about 2.5 grams per cubic centimeter.

The composition of the media elements will generally be such that the average weight reduction caused by their agitation in the process will not exceed about 0.1 percent per hour, and the media elements will remain substantially free of sharp edges. In some instances, fusion of the oxide grains to convert them to a coherent mass will be achieved by heating at an elevated temperature and in a reducing atmosphere, and the temperature will typically be about 1,175° Centigrade.

The active ingredients of the surface-conversion solution employed in the process will advantageously include the oxalate radical, preferably in a concentration of about 0.125 to 0.65 gram mole per liter. It may also include about 0.05 to 0.15 gram mole per liter of the phosphate radical, at least about 0.004 gram mole per liter of the nitrate radical, and about 0.001 to 0.05 gram mole per liter of the peroxy group. The oxalate radical, nitrate radical and peroxy group may be provided, respectively, by oxalic acid, sodium nitrate and either hydrogen peroxide or sodium persulfate.

When the process is carried out in a vibratory mass finishing unit, it will advantageously be operated at an amplitude of 2 to 4 millimeters; the volumetric ratio of objects to media can vary throughout a wide range, but in most instances will be about 0.1 to 3:1. Typically, the metal surfaces of the objects will have an arithmetic average roughness (Ra) value of at least about 100, and will be refined by the process to a substantially ripple-free condition with a roughness value which is most desirably about 2 or lower. Arithmetic average roughness expresses the arithmetic mean of the departures of the roughness profile from the mean line; as used herein and in the appended claims, Ra is stated in microinches. Generally, the process will require less than about ten hours, and in the preferred embodiments ultimate surface quality will be achieved in seven hours or less.

Exemplary of the efficacy of the present invention are the following specific examples:

EXAMPLE ONE

An aqueous solution is prepared by dissolving a mixture of 80 weight percent oxalic acid, 19.9 weight percent sodium tripolyphosphate, and 0.1 weight percent sodium lauryl sulfonate, the mixture being added in a concentration of 60 grams per liter of water. The bowl of a vibratory mass finishing unit, having a capacity of about 280 liters, is substantially filled with solid media and rectangular steel blocks measuring 5.1 cm×7.6 cm×1.3 cm, in a block:media ratio of about 1:3; the blocks are of hardened, high carbon steel, and have a Rockwell "C" value of 45 and an arithmetic average surface roughness value of about 110–120, as determined by a "P-5" Hommel Tester. Media of four different compositions are employed; each has been preconditioned, as necessary to remove sharp edges:

Media "A" is a mixture of two standard abrasive ceramic materials of angle-cut cylindrical form, loaded with aluminum oxide grit having a particle size of about 65 to 80 microns. Approximately half of the media volume is comprised of cylinders about 1 centimeter (cm) in diameter and 1.6 cm long, containing 20 percent grit loading and exhibiting a density of 2.4 g./cc; the balance comprises cylinders about 1.3 cm in diameter and 1.9 cm long, with a 30 percent grit loading and a density of about 2.5 g./cc. The mixed media exhibits a bulk density of about 1.6 g./cc and an average diamond pyramid hardness (DPH) value of 780 (as reported herein, all DPH values are determined by ASTM method E-384 using a 1,000 gram load, and are the average of three readings). In composition, the media elements consist of a mixture of oxides, and contain the following elements, the approximate weight percentages of which (on an oxygen-free basis) are indicated in parentheses: silicon (51), aluminum (36), magnesium (3), calcium (3), titanium (2), potassium (2), iron (1.5) and sodium (1.5).

Each of the media hereinafter designated "B", "C" and "D" is a mixture of oxide grains, fused to a coherent mass; in all three media the grain size ranges from about 1 to 25 microns in diameter, and they are substantially free of discrete abrasive particles (i.e., particles of a grit such as alumina and silica measuring about 50 microns or larger).

In composition, Media B contains (on an oxygen-free basis) the following elements (here, and below, the approximate weight percentages are again indicated in parenthesis): aluminum (65), silicon (28), sodium (3), potassium (2), calcium (1.5) and phosphorous (0.5). The elements of the Media B are cylindrical, measuring about 1.3 cm in diameter and 1.9 cm in length, and they have a density of about 2.75 g./cc; the mass of elements exhibits an average DPH of about 890 and has a bulk density of about 1.72 g./cc.

Media C is commercially available as a burnishing media, and is composed (on the same approximate oxygen-free basis) of aluminum (69), manganese (16), silicon (12) and sodium (2), the remainder being calcium, potassium and chlorine in concentrations below one percent; the grains are about 1 to 11 microns in size and are of mixed platelet and rod-like shape. The elements of the media are about 0.8 cm in diameter and 1.6 cm long, they have a density of about 3.08 g./cc, and the mass of elements exhibits a DPH of about 890 and has a bulk density of about 1.9 g./cc.

Media D is also commercially available as a burnishing media, and is nominally composed of aluminum (77), silicon (11), iron (7) and titanium (5), again on an oxygen-free basis, with grains about 1 to 25 microns in maximum dimension, and of mixed platelet and granular shape. The cylindrical elements of which it consists measure about 1.3 cm in diameter, the length of half of them being about 0.8 cm, and of the other half being about 2.2 cm; they have a density of about 3.3 g./cc, and the mass of elements has a bulk density of about 2.3 g./cc and a DPH of about 1130.

The vibratory finishing unit is operated at about 1,300 revolutions per minute and at an amplitude setting of 4 millimeters. The solution is added at room temperature, on a flow-through basis (i.e., fresh solution is continuously introduced and the used solution is continuously drawn off and discarded) at the rate of about 11 liters per hour. Operation of the equipment generates sufficient heat to increase the temperature of the solution to about 35° Centigrade.

Table One below sets forth the results of runs carried out with the several media described. In the Table, the "Time" entry (expressed in hours) indicates the period of operation that is required to produce the corresponding final arithmetic average roughness value set forth in the "Ra" column; to determine it, samples are removed at about one-hour intervals from the bowl, and when no substantial improvement is noted the "final" Ra value is deemed to have been attained. Thereafter, the bowl is flushed with water, and is operated for an additional hour with a burnishing solution (one percent alkaline soap in water) substituted for the chemical conversion formulation, at the same flow rate. The ultimate level of surface refinement is indicated by the "Rating" value, which is based upon a subjective evaluation, on a scale of 1 to 5, made using a lined sheet held perpendicular to the metal workpiece surface. A value of "1" indicates specular brightness and a value of "5" indicates complete nonreflectivity; "3" indicates some reflectance, but with hazy and broken lines, and Ratings of "2" and "4" designate intermediate conditions, as will be self evident. The Attrition data indicate the average percentage weight loss per hour of the media that occur during the runs.

TABLE ONE

| Media | Time | Ra | Rating | Attrition |
|---|---|---|---|---|
| A | 14 | 4–5 | 4 | 0.17 |
| B | 10 | 3–4 | 2 | 0.10 |
| C | 16 | 3–4 | 2 | 0.10 |
| D | 7 | 1–2 | 1 | 0.06 |

The data in the Table indicate that Media D produces a highly refined surface on the blocks in what is, as a practical matter, a very brief period of time, and with a very low rate of media attrition; indeed, in tests of long duration average attrition rates as low as 0.015 percent per hour are realized with this media. The results achieved with Media B are less impressive, but are still highly desirable. Although abrasive Media A achieves its ultimate refinement at a faster rate than does Media C, it will be noted that the ultimate surface quality is decidedly inferior, and that the media attrition loss is substantially greater.

As noted above, the Ra values expressed are determined using a "P-5" Hommel Tester, which is the basis for all Ra data contained herein and in the appended claims. It is recognized that more sophisticated test apparatus would give different (and generally higher) values; they would, however, correlate proportionately, so that these data are believed to accurately represent performance of the several media employed.

EXAMPLE TWO

The procedure of Example One is repeated using Media B, C and D, substituting however for the solution employed therein a formulation in which the active ingredients (again dissolved at a concentration of 60 grams of the mixture per liter of solution) consist of about 79.5 percent oxalic acid, 20 percent sodium nitrate and 0.5 percent of sodium lauryl sulfonate; 0.3 percent (by volume of the solution) of standard, 35 percent hydrogen peroxide reagent is also included. Levels of surface refinement similar to those reported in Table One are realized with the several Media, but at rates that are significantly higher than those indicated therein.

Although the theory of operation of the present invention is not fully understood, it is believed that the high degree of refinement, ultimately to achieve a specular condition in many instances, is attributable to the utilization of a burnishing media rather than a media having abrasive characteristics. Because of this, the cutting and scratching that necessarily accompany the use of an abrasive media are avoided, resulting in the more ready attainment of the final burnished surface.

Essential to the ability of the process to take a relatively rough metal surface (e.g., having a Ra value of 100 or more) to a condition of high refinement, and ultimately to a specular state, is the use of a chemical solution which is capable of converting the metal surfaces of the workpieces to a softer, or less coherent or tenacious, form. As taught in the above-identified Michaud et al patent, the conversion coating may advantageously be in the form of an oxide, phosphate, oxalate, sulfate or chromate of the metal, and it is believed that other reaction products may also be effective in the process, as well. The use of a burnishing media, in lieu of the abrasive media disclosed in the prior art, would not be expected to produce the surface refinement achieved by the practice of the present invention, and this is especially so considering the relatively brief periods of time that have been found to be sufficient in accordance herewith.

It is believed to be essential to the success of the present invention that the media employed have certain minimum density values, as hereinabove specified; there appear to be preferred upper limits upon those parameters as well, which have also been set forth. For example, it has been found that the use of steel balls in the process of the invention is not desirable because a substantial "ripple" or "orange peel" effect (i.e., a gentle but readily perceptible undulation) tends to be produced on the surface of the workpieces; this result is thought to be attributable to the very high density of the steel, although other factors, such as the relative hardness of the balls and the workpiece surfaces, are also believed to contribute. In addition, it might be mentioned that metallic media elements may be unsuitable for use in the instant process, due to reactivity in the chemical treatment solutions; this will of course depend upon the metal involved and the composition of the solution employed.

As discussed hereinabove, it is of prime importance that the media elements used be free from abrasive grit (i.e., particles of the alumina, silica or the like, having a diameter of 50 microns or larger) which typify conventional cutting media of the ceramic type. Not only do such grit particles cause scratching of the workpiece surfaces, as mentioned above, but they are also characterized by a fracturing action during use, which is necessary for efficiency but which produces ecologically significant particulates or fines, which must be removed from the processing solutions prior to disposal. As noted, degradation of the ceramic matrix also contributes to the disposal problem, both by generating and also by releasing particles.

Another advantage that results from the minimization of free particulates in the liquid medium concerns surface contamination of the workpiece. Even at low levels of impact, the force of contact among the parts and media produces some embedment of free particles into the workpiece surfaces, making final finishing (e.g., electroplating) difficult, and often requiring rigorous post-treatment to remove the contamination. Obviously, the problem will be mitigated to the extent that particulates are avoided, and this is of course particularly desirable where (as in the instant method) the media is of relatively high density, and hence capable of developing significant levels of kinetic energy.

It should be noted that, although media attrition rates may be determined in the course of treating parts, more reproducible values will usually result by agitating the media alone, in a soap solution; attrition values will be about the same, however, regardless of whether or not parts are present. The rates reported herein are determined in a vibratory bowl having a capacity of about 280 liters, substantially filled with the media and operated at about 1300 revolutions per minute and an amplitude of 4 millimeters, with a soap solution flowing through the bowl at the rate of about 11 liters per hour. In most instances, the run is continued for 48 hours; when the media is especially resistant to attrition, however (as in the case of media "D" above), it will be carried out for 96 hours or more, to improve the accuracy of the data. The media will usually be conditioned (i.e., run without parts) for a period of one hour or more before use, as necessary to round-off sharp edges; here again, the more durable the material the longer will be the breaking-in period.

Perhaps it should be emphasized that the media employed in the instant process have fine, granular structures, in which the grains are fused to a coherent mass and have relatively smooth surfaces; they will typically be of mixed platelet and granular or rod-like form. Usually, the media will be composed of the constituent oxides mixed within the individual grains, and are to be contrasted with abrasive media containing grit particles of an oxide of a single element (e.g., aluminum).

Although the details of the processes by which media most suitable for use herein are produced are unknown to the inventors, it is believed that the appropriate mixture of mineral oxides is extruded as a dense paste or slurry, with the extrudate being cut or otherwise subdivided to the desired size and form. The "green" media is then baked to dryness, following which it is fired in a reducing atmosphere; a typical firing temperature is believed to be on the order of about 1,175° Centigrade.

As indicated above, the media elements may take a wide variety of sizes and shapes. Thus, they may be angle-cut cylinders, they may be relatively flat pieces that are round, rectangular or triangular, or they may be of indefinite or random shapes and sizes. Generally, the smallest dimension of the media elements will not be less than about 0.6 cm, and the largest dimension will usually not exceed about 3 cm. The size and configuration of the elements that will be most suitable for a particular application will depend upon the weight, dimensions and configuration of the workpieces, which will also indicate the optimal ratio of parts-to-media, as will be evident to those skilled in the art. In regard to the latter, an important function of the media is to ensure that the parts slide over one another, and that direct, damaging impact thereamong is minimized. Consequently, when the parts are relatively large and are made of a highly dense material a high proportion of media will be employed; e.g., a media:parts ratio of about 10:1, or even greater in some instances. On the other hand, when the workpieces are relatively small and light in weight they develop little momentum in the mass finishing apparatus, and consequently a ratio of parts-to-media of about 3:1 may be suitable.

Although other kinds of mass finishing equipment, such as vented horizontal or open-mouth barrels, and high-energy centrifugal disc machines, may be used, the process of the invention will most often be carried out in a vibratory finishing unit. Typically, the unit will be operated at 800 to 1,500 rpm and at an amplitude of 1 to 8 millimeters; preferably, however, the amplitude setting will be at 2 to 4 millimeters. Indeed, one of the advantages of the invention is that it enables finishing to be carried out at amplitude settings that are lower than would otherwise be required, which reduction is believed to be attributable to the more efficient energy transfer that results from the use of media of high density. In addition to decreasing power demands, lower amplitudes also appear to contribute to the minimization of the ripple effect that might otherwise result from the use of such media.

An essential aspect of the invention is of course the utilization of a solution in the finishing operation that is capable of converting the surfaces of the workpieces to a reaction product that is more easily removed than is the basis metal. This general concept is fully described in the above-discussed Michaud et al patent, and the formulations described therein can be utilized to good effect in the practice of the present invention. Other formulations that are highly effective for the same purpose are described and claimed in copending application for Letters Patent Ser. No. 929,790, filed on Nov. 20, 1986 in the names of Robert G. Zobbi and Mark Michaud and entitled Composition and Method for Metal Surface Refinement, which has now issued as U.S. Pat. No. 4,705,594. From the foregoing, and from the Examples and disclosure hereinabove set forth it will be appreciated that a wide variety of compositions can be employed in the practice of the present invention, and the selection of specific formulations will be evident to those skilled in the art, based thereupon.

Generally, the active ingredients of such a composition will be dissolved in water, and will provide a total concentration of 15 to 250 grams per liter; this will depend significantly, however, upon the specific ingredients employed. It will be more common for the concentration of active ingredients to be in the range of about 30 to 100 grams per liter, and in most instances the amount will not exceed about 60 grams per liter.

The solution may be utilized in any of several flow modes, but best results will often be attained by operating on a continuous flow-through basis, as described above; a typical rate will be about 11 liters per hour. Alternatively, the solution may be employed on a batchwise basis, or it may be recirculated through the equipment; it will normally be introduced at room temperature, in any event.

Thus, it can be seen that the present invention provides a novel and highly effective process for the refinement of metal surfaces, utilizing a physicochemical finishing technique. Surface refinement is achieved in one step to levels and at rates that are enhanced over comparable methods of the prior art; specifically, surfaces of arithmetic average roughness less than 2 and of specular brightness can be attained in refinement periods of less than 10, and in many instances less than 7, hours, starting with a surface having a rating of about 100 Ra. The process of the invention offers improved economy and facility, as compared to prior processes of the same kind, and it also affords advantages from an environmental standpoint.

Having thus described the invention, what is claimed is:

1. A process for the refinement of metal surfaces of objects, in which a mass of elements, including a quantity of objects having relatively rough metal surfaces, and a solution capable of converting said surfaces to a softer form, are introduced into the container of a mass finishing unit and are rapidly agitated therein for a period of time to produce relative movement among said elements and to maintain said surfaces in a wetted condition with said solution, for conversion of any metal exposed thereon, on a continuous basis, so as to thereby effect a significant reduction in roughness by chemical and mechanical action; wherein the improvement comprises the inclusion in said mass of elements of a quantity of relatively heavy and nonabrasive solid media elements, the amount and size of which are selected to promote relative sliding movement thereamong and with respect to said objects, under the conditions of agitation, said media elements being composed of a mixture of oxide grains fused to a coherent mass having a density of at least about 2.75 grams per cubic centimeter, and being substantially free of discrete abrasive particles, the composition of said media elements being such that the average weight reduction thereof is less than about 0.1 percent per hour, as determined in a vibratory bowl having a capacity of about 280 liters, substantially filled with said media elements and operated at about 1,300 revolutions per minute and an amplitude of 4 millimeters, with a soap solution flowing through the bowl at the rate of about 11 liters per hour, said quantity of media elements having a bulk density of at least about 1.70 grams per cubic centimeter.

2. The process of claim 1 wherein, excluding oxygen, said coherent mass consists essentially of about 76 to 78 weight percent aluminum, about 10 to 12 weight percent silicon, about 5 to 9 weight percent iron, and about 4 to 6 weight percent titanium.

3. The process of claim 2 wherein said mixture of oxide grains is heated at an elevated temperature and in a reducing atmosphere to produce said coherent mass.

4. The process of claim 3 wherein said elevated temperature is about 1,175° Centigrade.

5. The process of claim 1 wherein, excluding oxygen, said coherent mass consists essentially of about 63 to 67 weight percent aluminum, about 26 to 30 weight percent silicon, about 2 to 4 weight percent sodium, about 1 to 2 weight percent potassium, and about 0.5 to 0.8 weight percent phosphorous.

6. The process of claim 1 wherein, excluding oxygen, said coherent mass consists essentially of about 62 to 73 weight percent aluminum, about 7 to 14 weight percent silicon, about 10 to 25 weight percent manganese, and about 1 to 4 weight percent sodium.

7. The process of claim 1 wherein said oxide grains of which said coherent mass is composed have diameters not in excess of about 25 microns.

8. The process of claim 7 wherein substantially all of said oxide grains have diameters of at least about 1 micron.

9. The process of claim 1 wherein said coherent mass has a density of less than about 3.5 grams per cubic centimeter and a diamond pyramid hardness value of from about 845 to 1,200, as determined by ASTM method E-384 using a 1,000 gram load, and wherein said quantity of media elements has a bulk density of less than about 2.5 grams per cubic centimeter.

10. The process of claim 1 wherein said quantity of objects and said quantity of media elements are present in said mass of elements in a volumetric, objects:media ratio of about 0.1 to 3:1.

11. The process of claim 1 wherein the smallest dimension of said media elements is not less than about 0.6 centimeter.

12. The process of claim 1 wherein said media elements remain substantially free of sharp edges during said period of time.

13. The process of claim 1 wherein said solution is an aqueous solution, the active ingredients of which include the oxalate radical.

14. The process of claim 13 wherein said solution contains about 0.125 to 0.65 gram mole per liter of the oxalate radical.

15. The process of claim 14 wherein said solution contains about 0.05 to 0.15 gram mole per liter of the phosphate radical.

16. The process of claim 14 wherein said solution includes at least about 0.004 gram mole per liter of the nitrate radical.

17. The process of claim 16 wherein said solution contains about 0.001 to 0.05 gram mole per liter of the peroxy group.

18. The process of claim 17 wherein said oxalate radical, nitrate radical and peroxy group are provided, respectively, by oxalic acid, sodium nitrate and either hydrogen peroxide or sodium persulfate.

19. The process of claim 14 wherein said solution contains about 0.001 to 0.05 gram mole per liter of the peroxy group.

20. The process of claim 1 wherein said relatively rough metal surfaces have an arithmetic average roughness value of at least about 100, said significant reduction producing a substantially ripple-free surface with an arithmetic average roughness value of about 2 or less, and said period of time being less than about 10 hours, said arithmetic average roughness values being those that would be determined using a "P-5" Hommel Tester or equivalent apparatus, and being expressed in microinches.

21. The process of claim 1 wherein said rapid agitation is carried out in a vibratory mass finishing unit operating at an amplitude of 2 to 4 millimeters.

22. A process for the refinement of metal surfaces of objects, in which a mass of elements, including a quantity of objects having relatively rough metal surfaces, and a solution capable of converting said surfaces to a softer form, are introduced into the container of a mass finishing unit and are rapidly agitated therein for a period of time to Produce relative movement among said elements and to maintain said surfaces in a wetted condition with said solution, for conversion of any metal exposed thereon, on a continuous basis, so as to thereby effect a significant reduction in roughness by chemical and mechanical action; wherein the improvement comprises the inclusion in said mass of elements of a quantity of relatively heavy and nonabrasive solid media elements, the amount and size of which are selected to promote relative sliding movement thereamong and with respect to said objects, under the conditions of agitation, said media elements being composed of a mixture of oxide grains having diameters of about 1 to 25 microns, fused to a coherent mass and having a density of at least about 2.75 grams per cubic centimeter and a diamond pyramid hardness value of about 845 to 1,200, as determined by ASTM method E-384 using a 1,OOO gram load, and being substantially free of discrete abrasive particles, the composition of said media elements being such that the average weight reduction thereof is less than about 0.1 percent per hour, as determined in a vibratory bowl having a capacity of about 280 liters, substantially filled with said media elements and operated at about 1,300 revolutions per minute and an amplitude of 4 millimeters, with a soap solution flowing through the bowl at the rate of about 11 liters per hour, and also being such that said media elements will remain substantially free of sharp edges during said period of time, said quantity of media elements having a bulk density of about 1.70 to 2.5 grams per cubic centimeter, said improvement also including a step, effected prior to said period of time, of conditioning said media elements for a period of at least one hour, and in the absence of said objects, so as to round-off sharp edges thereof.

23. A process for the refinement, to a burnished condition, of metal surfaces of objects, in which a mass of elements, including a quantity of objects having relatively rough metal surfaces, and a solution capable of converting said surfaces to a softer form, are introduced into the container of a mass finishing unit and are rapidly agitated therein for a period of time to produce relative movement among said elements and to maintain said surfaces in a wetted condition with said solution, for conversion of any metal exposed thereon, on a continuous basis, so as to thereby effect a significant reduction in roughness by chemical and mechanical action, and in which said mass of elements is thereafter so agitated in said container with a liquid that is inert to said metal, substituted therein for said solution; wherein the improvement comprises the inclusion in said mass of elements of a quantity of relatively heavy and nonabrasive solid media elements, the amount and size of which are selected to promote relative sliding movement thereamong and with respect to said objects, under the conditions of agitation, said media elements being composed of a mixture of oxide grains fused to a coherent mass having a density of at least 2.75 grams per cubic centimeter, and being substantially free of discrete abrasive particles, the composition of said media elements being such that the average weight reduction thereof is less than about 0.1 percent per hour, as determined in a vibratory bowl having a capacity of about 280 liters, substantially filled with said media elements and operated at about 1,300 revolutions per minute and an amplitude of 4 millimeters, with a soap solution flowing through the bowl at the rate of about 11 liters per hour, said quantity of media elements having a bulk density of at least about 1.70 grams per cubic centimeter, said liquid being substituted for said solution without removal of said mass of elements from said container.

24. The process of claim 23 wherein said liquid is an alkaline aqueous soap solution.

25. The process of claim 23 including refining said metal surfaces to a specular condition.

* * * * *